US010962915B2

(12) United States Patent
Uchida

(10) Patent No.: US 10,962,915 B2
(45) Date of Patent: Mar. 30, 2021

(54) IMAGE PRINTING APPARATUS, READING APPARATUS, IMAGE PRINTING METHOD, AND PRINTING MEDIUM CONVEYANCE METHOD

(71) Applicant: CANON KABUSHIKI KAISHA, Tokyo (JP)

(72) Inventor: Naoki Uchida, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/814,135

(22) Filed: Mar. 10, 2020

(65) Prior Publication Data

US 2020/0292978 A1 Sep. 17, 2020

(30) Foreign Application Priority Data

Mar. 11, 2019 (JP) ..... JP2019-043646

(51) Int. Cl.
*G03G 15/00* (2006.01)

(52) U.S. Cl.
CPC ..... *G03G 15/65* (2013.01); *G03G 15/5029* (2013.01)

(58) Field of Classification Search
CPC ..... G03G 15/65; G03G 15/6517; G03G 15/6529; G03G 21/1695; G03G 2215/00556; G03G 2215/00569; G03G 2215/00599; G03G 2215/00721; B41J 11/0095; B41J 13/0009
See application file for complete search history.

(56) References Cited

U.S. PATENT DOCUMENTS

2010/0061745 A1* 3/2010 Ito ..... G03G 15/101 399/43
2010/0098471 A1* 4/2010 Satoh ..... G03G 15/6567 399/361
2016/0347053 A1* 12/2016 Kiyokawa ..... B41J 2/04586
2017/0094071 A1* 3/2017 Kato ..... G06K 15/16
2017/0266955 A1* 9/2017 Harada ..... B41J 3/46

FOREIGN PATENT DOCUMENTS

JP 2007-254094 A 10/2007

* cited by examiner

*Primary Examiner* — Thomas S Giampaolo, II
(74) *Attorney, Agent, or Firm* — Venable LLP

(57) ABSTRACT

To provide an image printing apparatus, a reading apparatus, an image printing method, and a printing medium conveyance method, with which occurrence of image unevenness or streaks due to conveyance is prevented, an image sensor reads an image area, so as to detect a conveyance amount of a printing medium. Further, the conveyance amount is corrected according to a distance between the image sensor and the printing medium, which is detected by a height detection sensor, so as to obtain a highly accurate conveyance amount.

13 Claims, 13 Drawing Sheets

IMAGE PRINTING APPARATUS, READING APPARATUS, IMAGE PRINTING METHOD, AND PRINTING MEDIUM CONVEYANCE METHOD

BACKGROUND OF THE INVENTION

Field of the Invention

The present invention relates to an image printing apparatus that prints an image on a conveyed printing medium, and, in particular, relates to an image printing apparatus including a detection unit configured to detect a conveyance amount of a printing medium, a reading apparatus, an image printing method, and a printing medium conveyance method.

Description of the Related Art

In some large-format printers, for detecting a conveyance amount of a printing medium, conveyance amounts are detected at multiple locations of the printing medium. In doing so, an image sensor may be mounted on a carriage that moves in the main scanning direction along the printing medium, so as to detect the conveyance amounts.

Japanese Patent Laid-Open No. 2007-254094 discloses a method for detecting a conveyance amount of a printing medium, based on a brightness-darkness pattern of the printing medium that is read by an image sensor.

The carriage is supported by a guide rail, and the carriage moves along the printing medium while being guided by the guide rail. However, a slight play is provided between the guide rail and the carriage for implementing such movement. Furthermore, in a case of a large-format printer, since the distance for the carriage to move along a printing medium is long, a manufacturing error of the guide rail can be greater due to the long distance. Due to the looseness between the guide rail and the carriage or the manufacturing error of the guide rail, etc., as described above, there is a case in which the position of the image sensor mounted on the carriage fluctuates from an ideal position while the carriage moves along the guide rail. In a case where the position of the image sensor fluctuates in such a large-format printer, if a conveyance amount of the printing medium is detected in the method disclosed in Japanese Patent Laid-Open No. 2007-254094, there is an issue that image unevenness or streaks due to conveyance occurs since desired detection accuracy cannot be obtained.

SUMMARY OF THE INVENTION

Therefore, the present invention provides an image printing apparatus, a reading apparatus, an image printing method, and a printing medium conveyance method, with which occurrence of image unevenness or streaks due to conveyance is prevented.

Accordingly, the image printing apparatus of the present invention includes a printing unit configured to perform printing by ejecting liquid onto a printing medium, a conveyance unit configured to convey the printing medium, a conveyance amount detection unit configured to detect a conveyance amount of the printing medium conveyed by the conveyance unit, a distance detection unit configured to detect a distance between the printing medium and the conveyance amount detection unit, and a correction unit configured to correct a detection result of the conveyance amount detection unit, based on a detection result of the distance detection unit.

According to the present invention, it is possible to provide an image printing apparatus, a reading apparatus, an image printing method, and a printing medium conveyance method, with which occurrence of image unevenness or streaks due to conveyance is prevented.

Further features of the present invention will become apparent from the following description of exemplary embodiments with reference to the attached drawings.

DESCRIPTION OF THE EMBODIMENTS

First Embodiment

Figure 1:
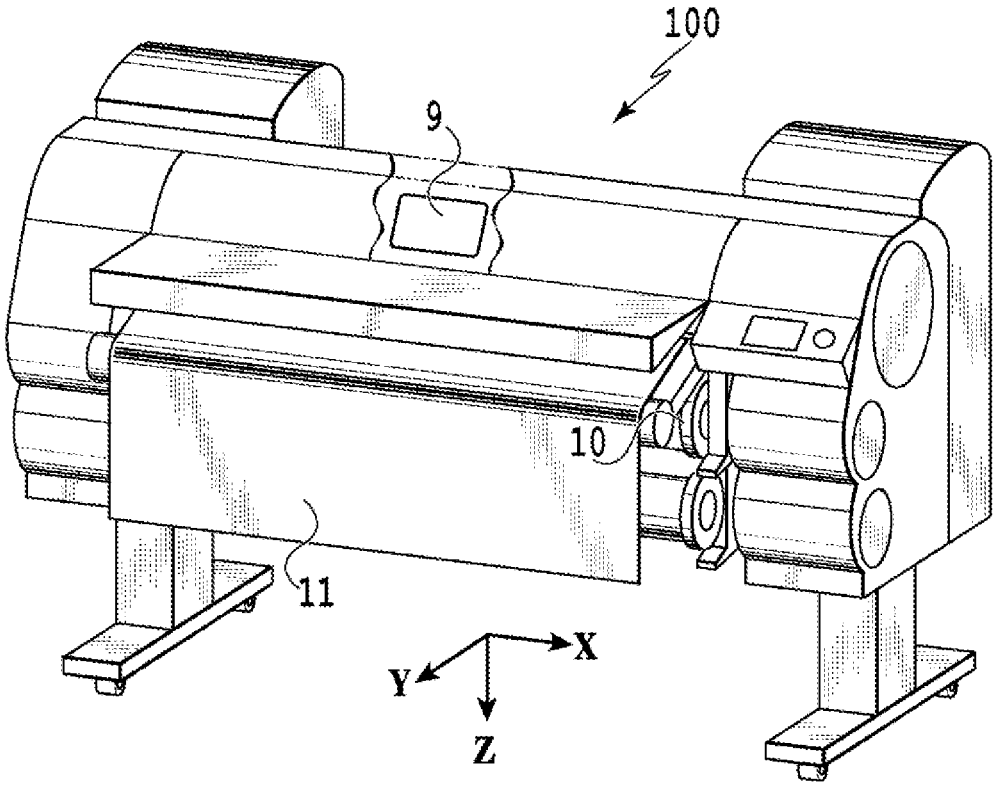
FIG. 1 is a perspective view illustrating the outer appearance of a large-format image printing apparatus.

FIG. 1 is a perspective view illustrating the outer appearance of a large-format image printing apparatus 100 to which the present invention can be applied. The image printing apparatus (hereinafter, also simply referred to as a printing apparatus) 100 performs printing by ejecting liquid from a nozzle of the later-described print head, which is removably mounted on a carriage 9 that moves, onto a printing medium 11 that is unrolled from a roll sheet, which is a rolled-up printing medium. Here, the X direction is the main scanning direction in which the carriage 9 scans, the Y direction is the direction in which a printing medium is discharged, and the Z direction is the vertically downward direction. The carriage 9 reciprocally moves along the printing medium 11 in the main scanning direction, which is the X direction, by driving of a carriage motor, which is not illustrated in the drawing. The printing apparatus 100 includes a carriage belt, which transmits driving force of the carriage motor to the carriage 9, and a guide rail, which is provided along the main scanning direction to support and guide the carriage 9 that moves. The printing medium 11 is conveyed by a conveyance unit (not illustrated in the drawing) in accordance with printing. In the printing apparatus 100, printing is performed by alternately repeating conveyance of a printing medium and printing.

Figure 2:
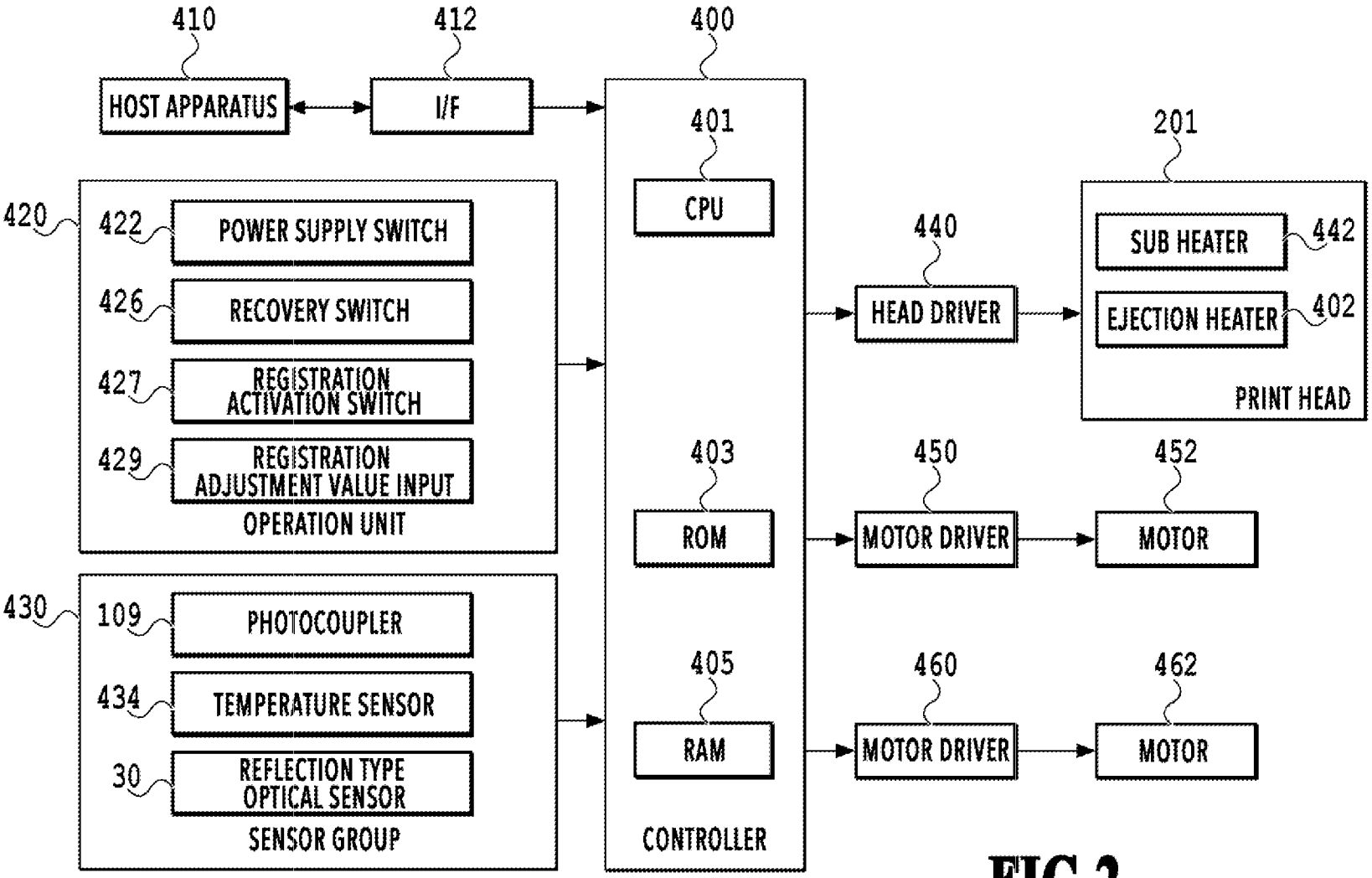
FIG. 2 is a block diagram illustrating a control system of the image printing apparatus.

FIG. 2 is a block diagram illustrating a control system of the printing apparatus 100. The controller 400 is a main control unit and includes, for example, a CPU 401, which is in the form of a microcomputer, a ROM 403, which stores a program or fixed data such as a necessary table, and a RAM 405, which is provided with an area to which image data is retrieved, a work area, or the like. The host apparatus 410, which is an external apparatus, serves as a supply source of image data. Specifically, the host apparatus 410 may be in such a form as a computer that creates or processes data, such as an image to be printed, or a reader unit for reading an image, etc. Image data or other commands generated by the host apparatus 410 are transmitted to the controller 400 via an interface (I/F) 412. Further, a status signal, or the like, of the printing apparatus 100 is received by the host apparatus 410 via the I/F 412.

The operation unit 420 is a switch group, to which an operator inputs instructions. The operation unit 420 includes a power supply switch 422 and a recovery switch 426 for instructing for activation of suction recovery. Further, the operation unit 420 includes a registration adjustment activation switch 427, which is for manually performing registration adjustment, a registration adjustment value setting input unit 429, which is for manually inputting an adjustment value, and the like. The sensor group 430 is a sensor group for detecting the state of the printing apparatus 100. The sensor group 430 includes the above-described reflection type optical sensor 30, a photocoupler 109 for detecting the home position, a temperature sensor 434 provided at a position apart from a heat generating portion of the printing apparatus 100 to detect the environment temperature, and the like.

The head driver 440 is a driver that drives the ejection heater 402 inside the print head 201 in accordance with print data, or the like. The head driver 440 includes a shift register, which is for arranging print data so as to correspond to the positions of the print head nozzles, and a latch circuit for latching at an appropriate timing. The head driver 440 further includes a logic circuit element, which is for operating the ejection heater 402 in synchronization with driving timing signals, a timing setting unit, which is for appropriately setting a driving timing (ejection timing) for registration of dot formation positions, and the like. The print head 201 is provided with a sub heater 442. The sub heater 442 is for adjusting the temperature in order to stabilize ejection characteristics of ink, and the sub heater 442 may be formed on a substrate together with the ejection heater 402 or may be attached to the print head 201 or a head cartridge.

The motor driver 450 is a driver that drives a main scanning (carriage) motor 452, which serves as a driving source for scanning of the carriage 9. Further, the motor driver 460 is a driver of a sub scanning (LF) motor 462, which is used for conveying (sub scanning) the printing medium 11.

Figure 3:
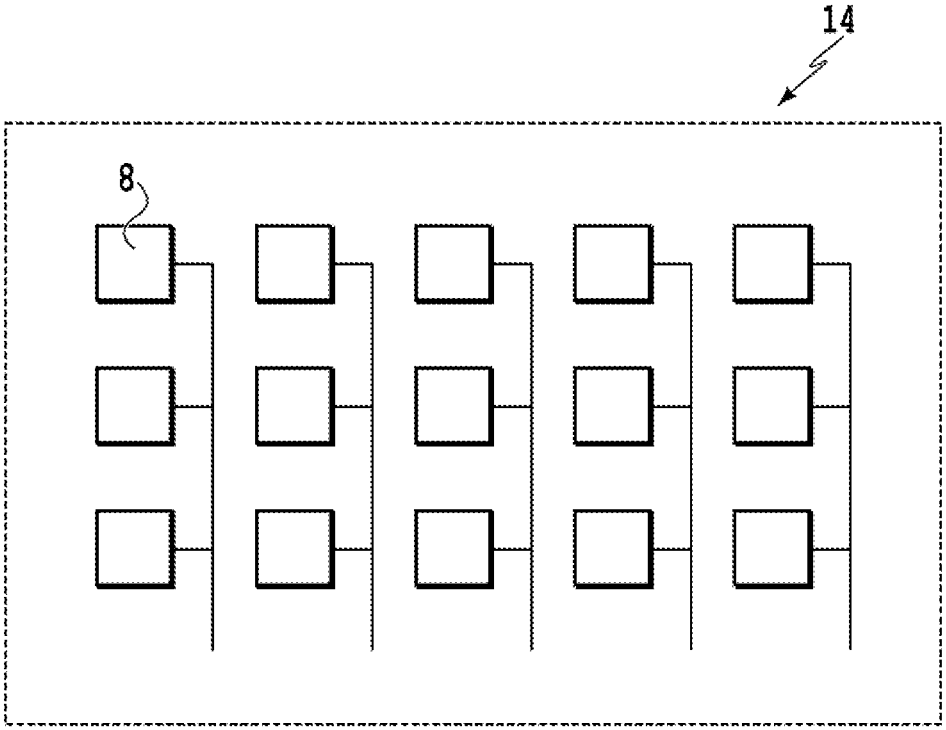
FIG. 3 is a diagram illustrating an image sensor used in the image printing apparatus.

FIG. 3 is a diagram illustrating the image sensor 14 used in the printing apparatus 100. The image sensor 14 is a detection device in which an array of multiple optical elements 8 is provided, so as to convert brightness and darkness of light received by a light receiving unit into electric signals and detect an image, based on the output of the optical elements 8. In the present embodiment, the image sensor 14 is used for detecting a conveyance amount of the printing medium 11. In order to detect a conveyance amount of the printing medium 11, first, a gazing point is determined in a predetermined image area on the printing medium 11. As for the gazing point, a fine uneven portion of the printing medium 11 or the shadow of the uneven portion may be selected. Note that there may be more than one gazing point.

The image sensor 14 reads the image area of the printing medium 11 before conveyance, and then reads the image area again after conveyance of the printing medium 11. Because the printing medium 11 is conveyed, the gazing point moves inside the image area. The pattern of the image area read before conveyance of the printing medium 11 and the pattern of the image area read after conveyance of the printing medium 11 are converted into electric signals and input to the controller 400, so as to calculate the displacement of the gazing point inside the image area. In this way, the image sensor 14 detects the moving amount of the gazing point that has moved. Then, the gazing point is changed, and the moving amount of the changed gazing point moved by conveyance of the printing medium 11 is detected by the image sensor 14 again. By comparing the moving amount of a gazing point with the theoretical value of the conveyance amount of the printing medium 11, it is possible to obtain the deviation amount between the theoretical value of the conveyance amount and the actual conveyance amount. In this way, by sequentially changing gazing points for each detection, it is possible to continuously detect conveyance amounts of the printing medium 11 and obtain deviation amounts of the conveyance amounts.

Figures 4A, 4B:
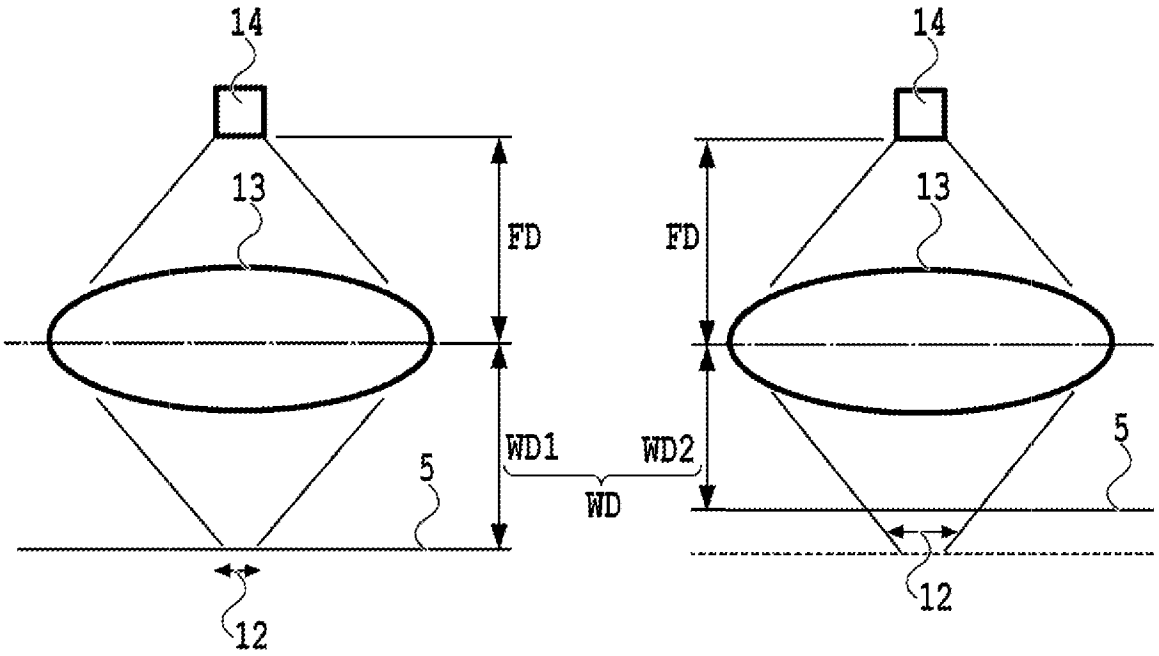
FIGS. 4A and 4B are explanatory diagrams illustrating a detection error in a case where the distance between the image sensor and a printing medium is different.

FIGS. 4A and 4B are diagrams for explaining a detection error in detection by use of the image sensor 14 in a case where the distance between the image sensor 14 and the printing medium 11 is different. Usually, the printing medium 11 is in a state of being supported by a platen (not illustrated in the drawings) in a case where printing is performed. FIG. 4A illustrates an ideal state in which the printing medium 11 is supported by the platen. FIG. 4B illustrates a state in which a part of the printing medium 11 is floating from the platen. The image sensor 14 generally has a configuration in which detection is performed on an object by use of light collected by a lens 13. Here, the distance from the image sensor 14 to the lens 13 is defined as a distance FD, and the distance from the lens 13 to the printing medium 11, which is an object, is defined as a distance WD. In FIG. 4A, the distance from the lens 13 to the printing medium 11, or the object, is the distance WD1, which is an ideal distance. In FIG. 4B, the distance from the lens 13 to the printing medium 11, or the object, is the distance WD2, which is shorter than the ideal distance WD1. That is, the distance WD1 and the distance WD2 have the following relationship: distance WD1>distance WD2.

The size of a pattern of the image area that is read in such a state where the printing medium 11 is not floating as illustrated in FIG. 4A is different from the size of a pattern of the image area that is read in such a state where a part of the printing medium 11 is floating as illustrated in FIG. 4B. Therefore, if a conveyance amount of the printing medium 11 is detected based on a pattern of the image area that is read in a state where a part of the printing medium 11 is floating, the conveyance amount cannot be accurately detected. Therefore, in order to accurately detect a conveyance amount of the printing medium 11, it is desired that the distance from the lens 13 to the printing medium 11, or the object, is the ideal distance WD1 before and after conveyance of the printing medium 11, as illustrated in FIG. 4A.

Figure 5:
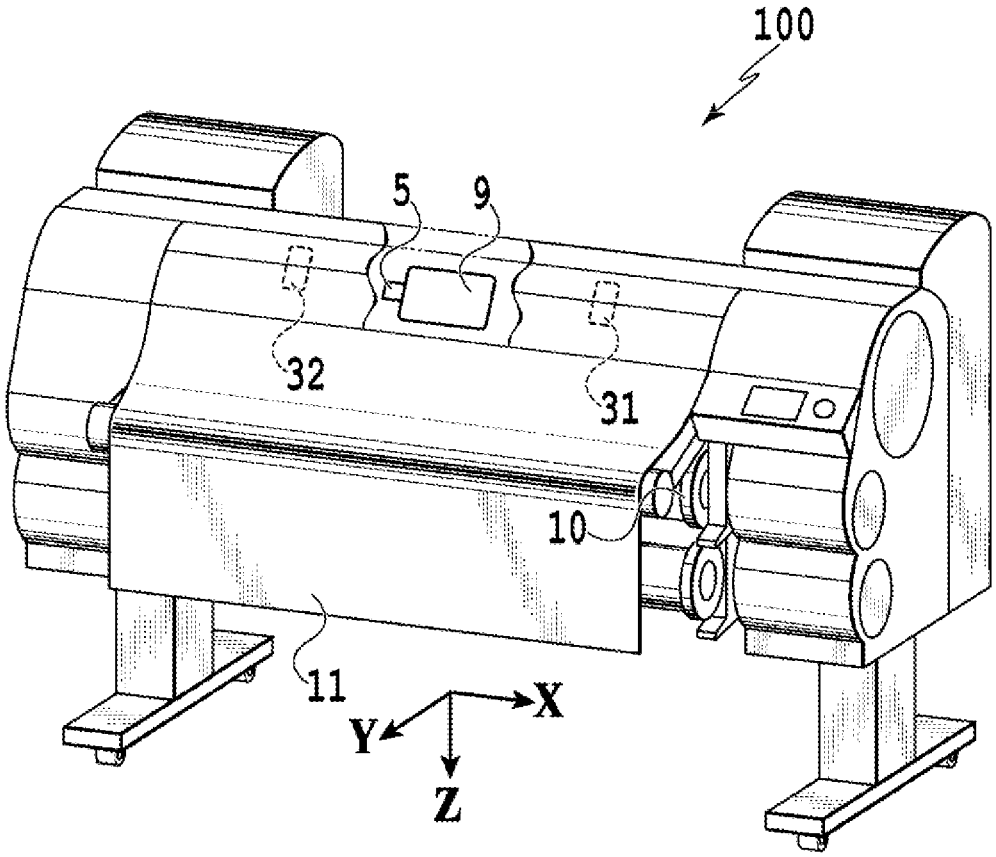
FIG. 5 is a diagram illustrating a sensor unit mounted on a carriage and a detection position.

FIG. 5 is a diagram illustrating a sensor unit 5 mounted on the carriage 9 and detection positions 31 and 32. In the present embodiment, the sensor unit 5 includes the image sensor 14 and is mounted on the carriage 9. The image sensor 14 moves together with the carriage 9 and detects conveyance amounts of the printing medium 11 at the first detection position 31 and the second detection position 32, which are on the movement path of the carriage 9 in the main scanning direction. In the large-format image printing apparatus 100, since the print swath in the main scanning direction (X direction) is large, fluctuation in conveyance amount relative to the rotation center of a conveyance roller at respective positions in the main scanning direction has a great effect on image quality formation. Therefore, in the present embodiment, conveyance amounts are detected at two detection positions in the main scanning direction.

Note that, here, although the explanation is given with the first detection position 31 and the second detection position 32, the detection positions are not limited to the first detection position 31 and the second detection position 32. Detection positions may be at given positions as long as the detection positions are on the movement path of the carriage 9 in the main scanning direction. Furthermore, the number of detection positions is not limited to two.

In a case where the image sensor 14 is mounted on the carriage 9 as illustrated in FIG. 5, there is a case in which the distance between the image sensor 14 and the printing medium 11 changes due to looseness between the guide rail and the carriage 9 or a manufacturing error of the guide rail, etc., while the carriage 9 moves in the main scanning direction. As a result, there may be an effect on conveyance amounts of the printing medium 11 to be detected.

Therefore, in the present embodiment, a deviation amount is obtained from a conveyance amount of the printing medium 11 that is detected by the image sensor 14, and the deviation amount is corrected based on a detection result obtained by detecting the distance between the image sensor 14 and the printing medium 11. As a result, it is possible to obtain a highly accurate conveyance amount of the printing medium 11. Hereinafter, the method for detecting the distance between the image sensor 14 and the printing medium 11 is specifically explained.

Figure 6A:
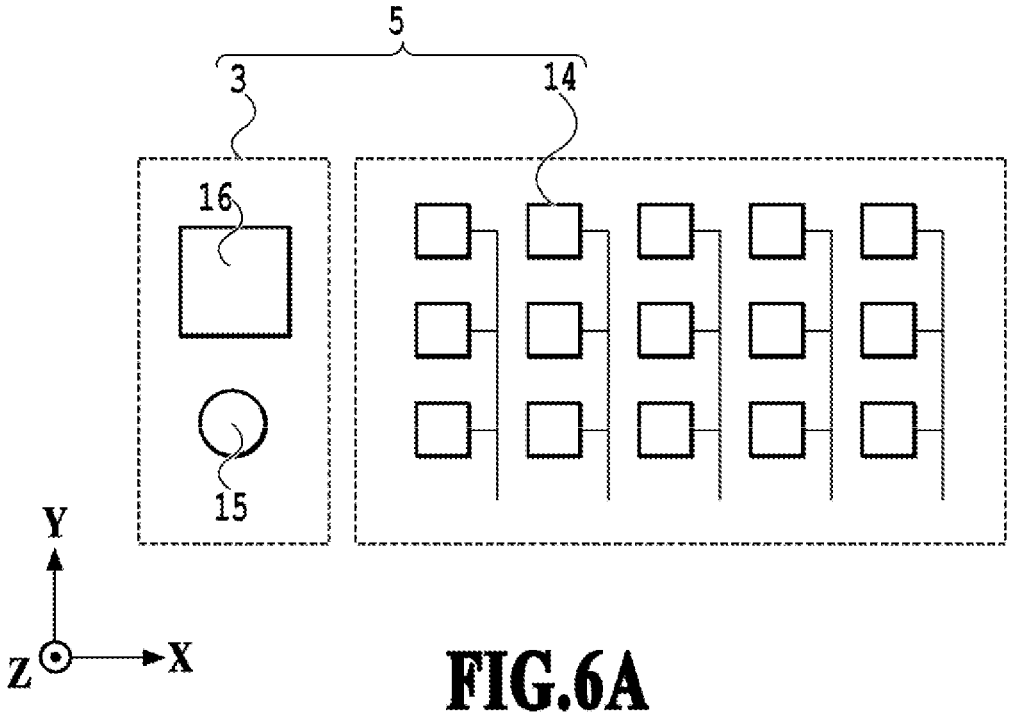
FIGS. 6A and 6B are diagrams illustrating the sensor unit including the image sensor and a height detection sensor.
Figure 6B:
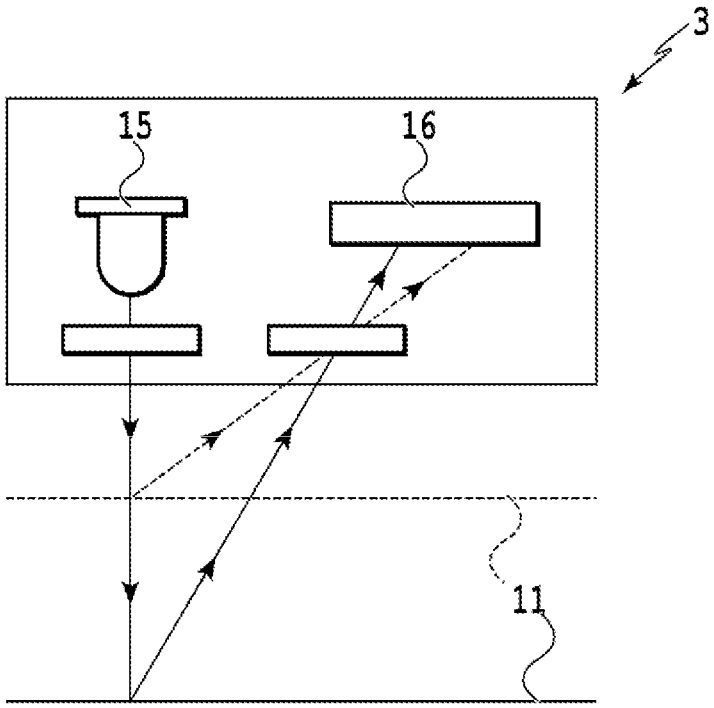

FIG. 6A is a diagram illustrating the sensor unit 5 including the image sensor 14 and the height detection sensor 3 in the present embodiment, and FIG. 6B is a diagram illustrating the height detection sensor 3. As illustrated in FIG. 6A, the height detection sensor 3 is disposed to be adjacent to the image sensor 14 in the X direction and includes the light emitting element 15, a lens (not illustrated in the drawings), and the position light receiving element (PSD: position sensitive device) 16. As illustrated in FIG. 6B, regarding the height detection sensor 3, light emitted from the light emitting element 15, which is a light source, is concentrated by the lens so as to irradiate the printing medium 11. Then, the reflected light from the printing medium 11 is concentrated on the position light receiving element 16 by the lens. Here, if the position (height) of the printing medium 11 is changed, the output of the position light receiving element 16 changes since the imaging position on the position light receiving element 16 changes. By calculation based on the output result of the position light receiving element 16, it is possible to detect the height of the position light receiving element 16 relative to the printing medium 11 (detection of the distance between the printing medium 11 and the position light receiving element 16). The height detection sensor 3 and the image sensor 14 are provided at positions facing the printing medium 11 that is conveyed. Further, the height detection sensor 3 and the image sensor 14 are provided at positions apart from the printing medium 11 by the same distance at the time of height detection. Thus, by detecting the height of the position light receiving element 16 relative to the printing medium 11, it is possible to detect the distance between the image sensor 14 and the printing medium 11.

Note that it is considered that there are two main causes of the height fluctuation between the image sensor 14 and the printing medium 11. One is that the distance between the carriage 9 and the platen, which supports the printing medium 11 on which printing is performed, becomes longer or shorter. The other is fluctuation caused by the printing medium 11 separating from the platen, which occurs in a case where a curling printing medium such as a roll sheet is conveyed. The distance between the image sensor 14 and the printing medium 11 fluctuates due to either one of the causes.

Figure 7:
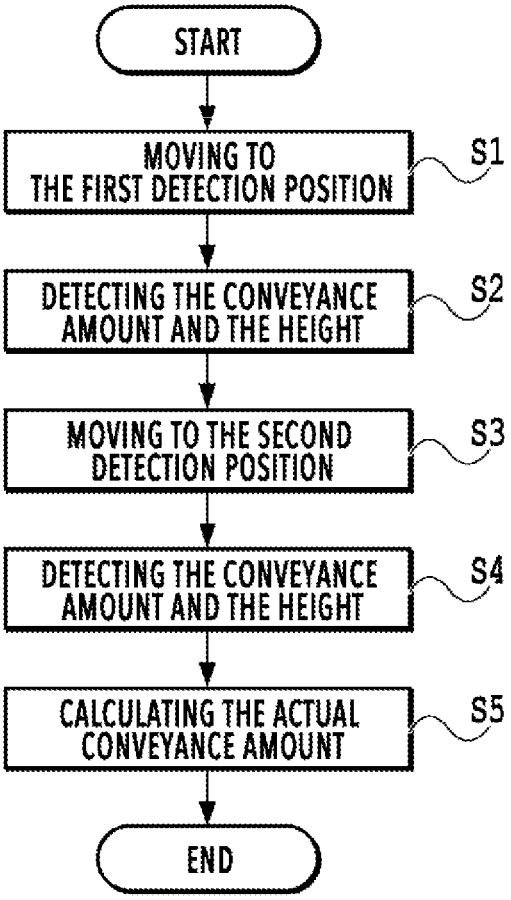
FIG. 7 is a flowchart of a conveyance amount detection processing for a printing medium in the image printing apparatus.

FIG. 7 is a flowchart of the conveyance amount detection processing for the printing medium 11 in the printing apparatus 100 of the present embodiment. Hereinafter, the conveyance amount detection processing for the printing medium 11 in the present embodiment is explained with reference to the flowchart. Note that the CPU 401 is the subject of performing each of the processes of the conveyance amount detection processing for the printing medium 11. Upon starting the conveyance amount detection processing, the carriage 9 is moved to the first detection position 31 in S1. Then, in S2, first, before conveyance of the printing medium 11, the image sensor 14 reads the image area at the first detection position 31, and the height detection sensor 3 detects the distance between the height detection sensor 3 and the printing medium 11. Subsequently, the printing medium 11 is conveyed by a predetermined amount while the carriage 9 stays at the first detection position 31. Then, the image sensor 14 reads the image area at the first detection position 31, and the height detection sensor 3 reads the distance between the height detection sensor 3 and the printing medium 11. Thereafter, the printing medium 11 is rewound to the origin position. Subsequently, in S3, the carriage 9 is moved to the second detection position 32. In S4, before conveyance of the printing medium 11, the image sensor 14 reads the image area at the second detection position 32, and the height detection sensor 3 detects the distance between the height detection sensor 3 and the printing medium 11. Subsequently, the printing medium 11 is conveyed by a predetermined amount while the carriage 9 stays at the second detection position 32. Then, the image sensor 14 reads the image area at the second detection position 32, and the height detection sensor 3 reads the distance between the height detection sensor 3 and the printing medium 11. Then, in S5, the deviation amount in the conveyance amount of the printing medium 11 is obtained based on the image area before conveyance and the image area after conveyance, which are read at the first detection position 31. Further, the obtained deviation amount is corrected based on the detection results of the distance between the height detection sensor 3 and the printing medium 11. Then, the deviation amount in the conveyance amount of the printing medium 11 is obtained based on the image area before conveyance and the image area after conveyance, which are read at the second detection position 32. Further, the obtained deviation amount is corrected based on the detection results of the distance between the height detection sensor 3 and the printing medium 11. As a result, it is possible to obtain a highly accurate conveyance amount of the printing medium 11.

Figure 8:
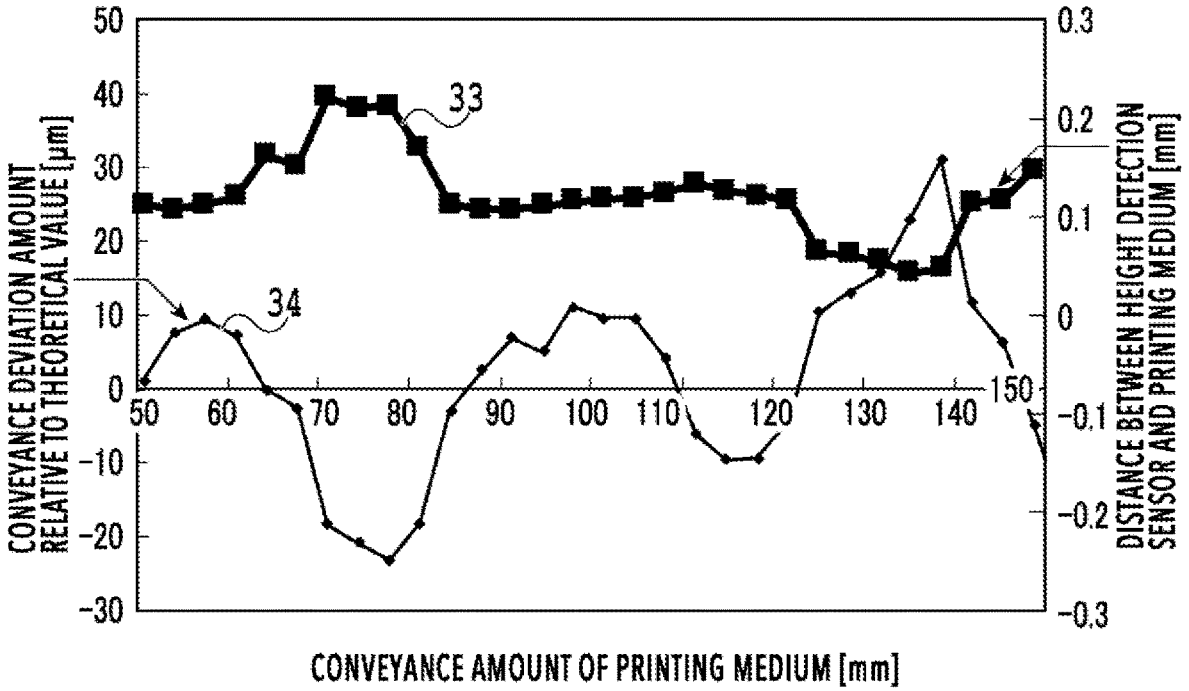
FIG. 8 is a diagram illustrating detection results obtained from the image sensor and the height detection sensor.

FIG. 8 is a diagram illustrating detection results obtained from the image sensor 14 and the height detection sensor 3. FIG. 8 illustrates graphs illustrating the results before deviation amounts are corrected. Regarding the graphs, the horizontal axis represents conveyance amount of the printing medium 11, and the vertical axis represents deviation amount of conveyance amount and distance between the height detection sensor 3 and the printing medium 11. The graph 34 indicates deviation amount of conveyance amount, and the graph 33 indicates distance between the height detection sensor 3 and the printing medium 11. Here, the example in which the printing medium 11 is conveyed within a conveyance amount of 50 mm to 150 mm by step feeding on a per 3 mm basis is illustrated, and a deviation amount is an amount of deviation of the printing medium 11 relative to a conveyance amount that the printing apparatus 100 recognizes as a theoretical value. For example, it is indicated that, at the position where the conveyance amount of the printing medium 11 is 100 mm, the conveyance amount that is approximately 10 μm longer than the theoretical value is detected. Furthermore, a distance between the height detection sensor 3 and the printing medium 11 represents a difference from the imaging position of the lens being at the position of 0 mm. For example, it is indicated that, at the position where the conveyance amount of the printing medium 11 is approximately 100 mm, the imaging position is deviated from the appropriate imaging position by 0.1 mm.

Figure 9:
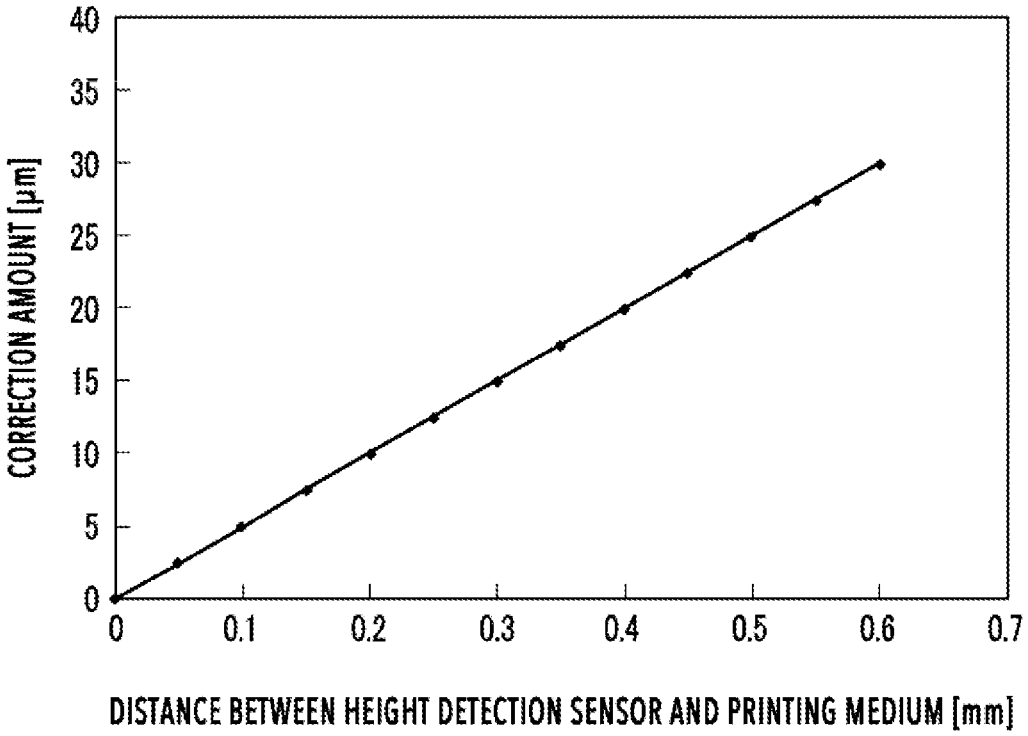
FIG. 9 is a graph illustrating correction amount for deviation amount.

FIG. 9 is a graph illustrating correction amount of deviation amount corresponding to distance between the image sensor 14 and the printing medium 11. Based on the graph, the deviation amounts of the conveyance amounts illustrated in FIG. 8 are corrected. By performing the correction, it is possible to obtain a highly accurate conveyance amount of the printing medium 11. A distance between the height detection sensor 3 and the printing medium 11 and a correction amount have a one-to-one relationship. Further, correction amount increases with increase of distance between the height detection sensor 3 and the printing medium 11. Note that, in the present embodiment, the correction values of deviation amounts illustrated in FIG. 9 are stored in the printing apparatus 100 as a table. However, the correction values may be provided in the host apparatus 410.

Here, the optimal distance between the image sensor 14 and the printing medium 11 is determined by imaging of a lens. A correction amount is determined based on a difference between the conveyance amount of the printing medium 11 at the optimal distance and an actual conveyance amount of the printing medium 11.

Figure 10:
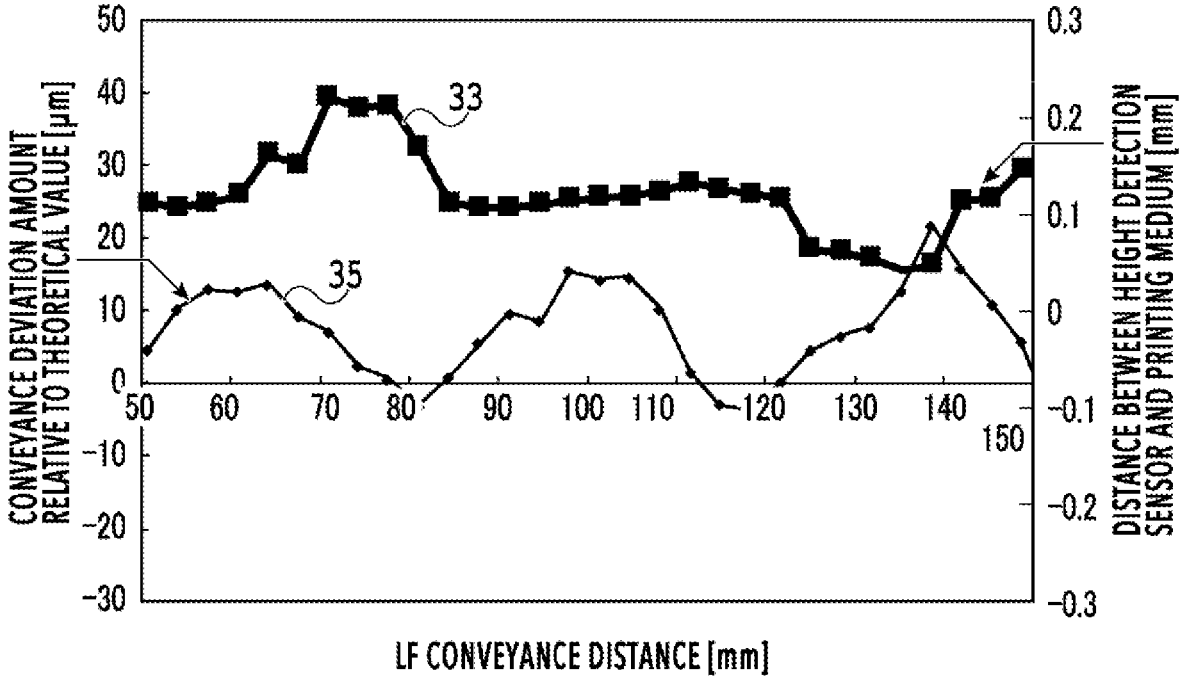
FIG. 10 is a graph illustrating results of correcting deviation amount of conveyance amount.

FIG. 10 is a diagram illustrating graphs indicating detection results obtained from the height detection sensor 3 and results obtained by correcting the deviation amounts of the conveyance amounts of FIG. 8, based on the graph of FIG. 9. The graph 33 that indicates distance between the height detection sensor 3 and the printing medium 11 is the same as the graph 33 of FIG. 8. The graph 35 is a graph indicating results obtained by correcting the graph 34 of FIG. 8. By correcting a deviation caused by fluctuation in distance between the image sensor 14 and the printing medium 11, it is possible to obtain a highly accurate conveyance amount.

Note that, although the present invention is explained with the example of the image printing apparatus 100 in the present embodiment, the present invention may be applied to a reading apparatus that reads an image printed on a printing medium.

Figure 11:
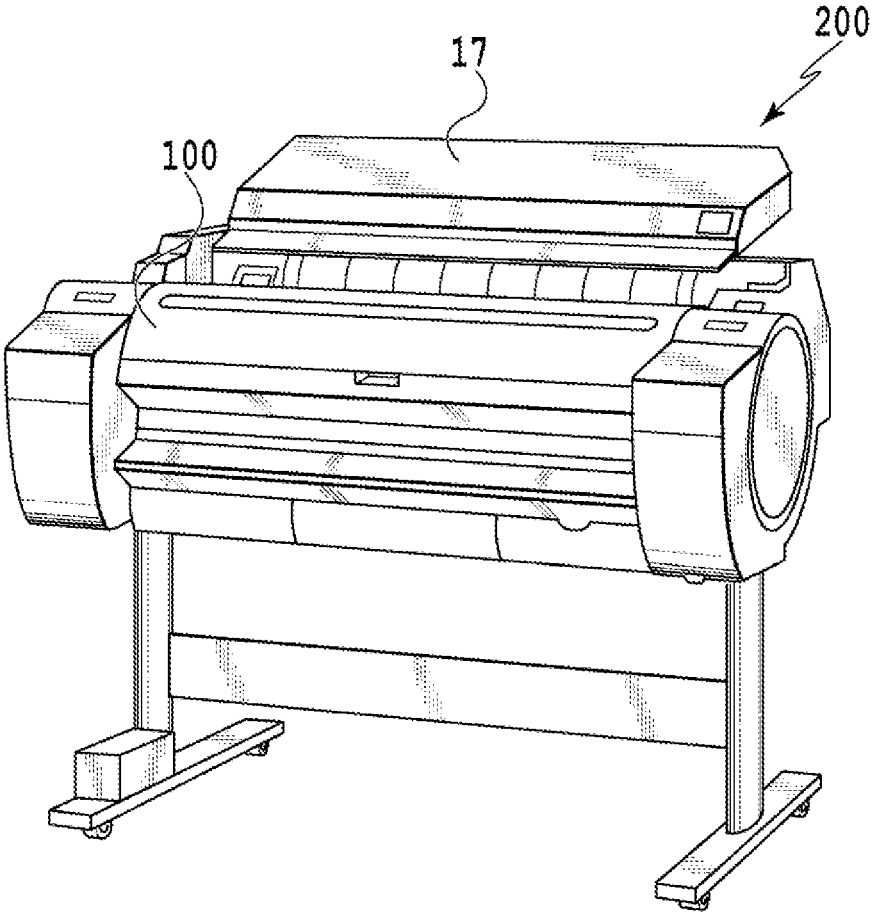
FIG. 11 is a perspective view illustrating a large-format reading apparatus.

FIG. 11 is a perspective view illustrating a large-format reading apparatus 200. The large-format reading apparatus 200 is a combination of a reading unit 17 and a printing apparatus 100. By conveying a document from the front to the back, detection is performed on a document in a large-format size by a linearly arranged sensor. The reading unit 17 for reading a large size document may be configured to scan a document or may be configured as a reading unit that drives a line sensor. However, in a case where the large-format reading unit 17 is configured as a system that drives a sensor, a reading table in a large-format size is necessary. Therefore, a configuration in which a document is scanned may be selected as a less expensive configuration. In such a configuration, the effect of the document conveyance accuracy on image formation is not small. In addition, it is often the case that a large-format document to be read is folded to be carried. Therefore, in a case where the folded document is opened and then read, the distance between the document and a detecting unit tends to fluctuate. In a case where fluctuation of the distance occurs, there is an issue that the printing medium cannot be conveyed with high accuracy, so that image unevenness or streaks due to conveyance occurs. In order to solve such an issue, the technology of the present invention is applicable to a reading apparatus, not only a printing apparatus.

Note that, although the printing apparatus 100 performs the calculation based on an output from the position light receiving element 16 in the present embodiment, the present invention is not limited to the embodiment. That is, it is possible that the calculation is performed by a computer, or the like, that is connected to the printing apparatus 100. Furthermore, it is also possible that the calculation based on an output from the position light receiving element 16 is performed by a computer, and the calculation result is transmitted to another printing apparatus that is not the printing apparatus 100. Accordingly, by applying the calculation result to other apparatuses, it is possible to reduce the number of times each apparatus performs correction of a conveyance amount of a printing medium other than a familiar printing medium.

As described above, by reading an image area by use of the image sensor 14, a conveying amount of the printing medium 11 is detected. Then, the conveyance amount is corrected in accordance with the distance between the image sensor 14 and the printing medium 11, which is detected by the height detection sensor 3, so that a highly accurate conveyance amount of the printing medium 11 is obtained. As a result, it is possible to implement an image printing apparatus, a reading apparatus, an image printing method, and a printing medium conveyance method, with which occurrence of image unevenness or streaks due to conveyance is prevented.

Second Embodiment

Hereinafter, an explanation is given of the second embodiment of the present invention with reference to the drawings. Note that the basic configuration of the present embodiment is the same as that of the first embodiment, and, therefore, only the characteristic configurations are explained below.

In the first embodiment, conveyance amount is corrected according to distance between the image sensor 14 and the printing medium 11. In the present embodiment, a highly accurate conveyance amount is obtained by correcting inclination of the carriage 9, which has an effect on a detection result of a conveyance amount obtained from the image sensor 14, that is, by correcting the effect caused by fluctuation of orientation of the carriage 9. There is a possibility that, while the carriage 9 moves in the main scanning direction, the image sensor 14 is inclined relative to the printing medium 11 in the main scanning direction due to a play between the guide rail and the carriage 9 or a manufacturing error of the guide rail, etc. As a result, there may be an effect on a conveyance amount of the printing medium 11 to be detected.

Figure 12A:
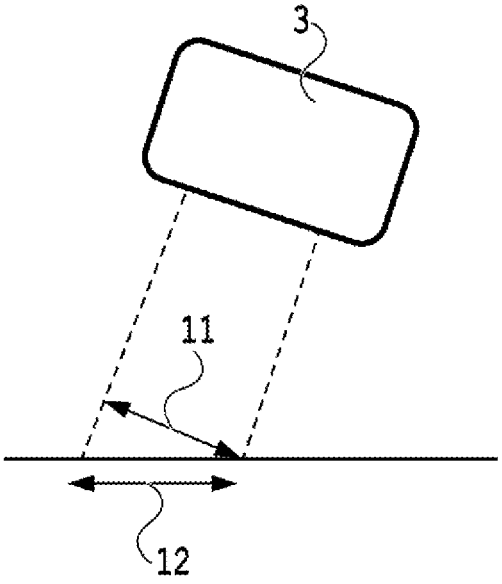
FIGS. 12A and 12B are diagrams for explaining a detection error in a case where the angle of the image sensor is different.
Figure 12B:
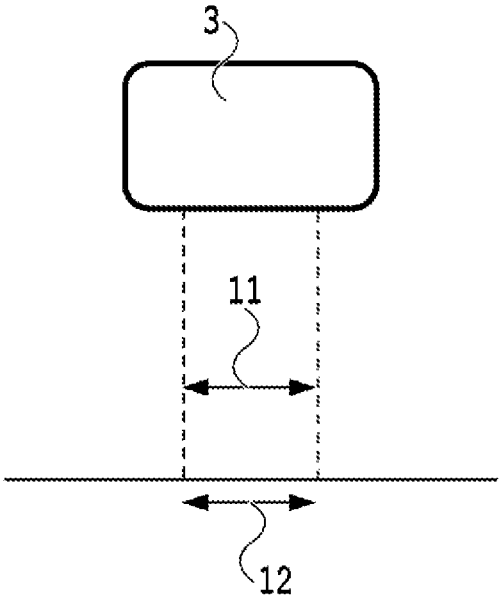

FIGS. 12A and 12B are diagrams for explaining a detection error in a case where the angle of the image sensor 14 relative to the printing medium 11 is different. In a case where the angle of the image sensor 14 relative to the printing medium 11 is different, a difference occurs in the length to be detected. The detected length 12 is longer in such a case where the printing medium 11 is inclined relative to the image sensor 14 as illustrated in FIG. 12A, compared to such a case where the image sensor 14 and the printing medium 11 face directly opposing each other as illustrated in FIG. 12B. Therefore, the result of a conveyance amount of the printing medium 11 detected in a state where the angle of the image sensor 14 relative to the printing medium 11 is different before and after conveyance of the printing medium 11 is different from the result of a conveyance amount of the printing medium 11 detected in a state where the angle is the same before and after conveyance of the printing medium 11. That is, in order to accurately calculate displacement of a gazing point, it is necessary to keep the angle of the image sensor 14 relative to the printing medium 11 the same before and after conveyance of the printing medium 11.

Figure 13:
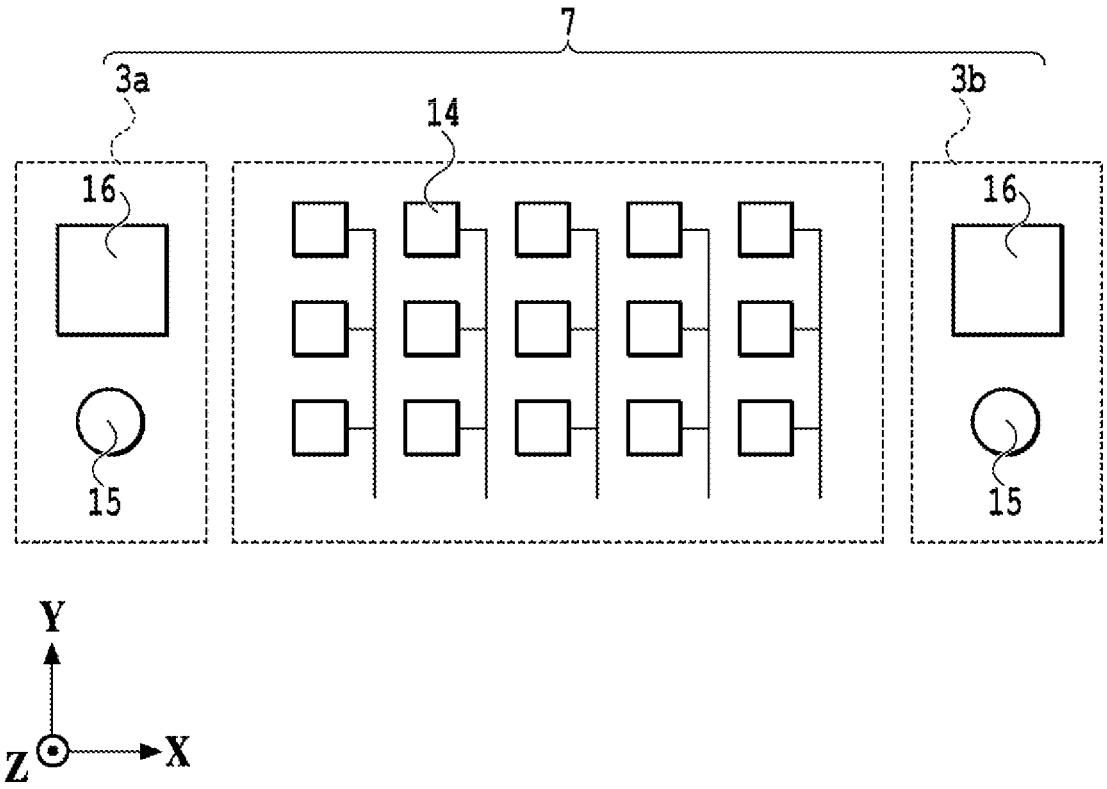
FIG. 13 is a diagram illustrating a sensor unit including an image sensor and a height detection sensor.

FIG. 13 is a diagram illustrating a sensor unit 7 including an image sensor 14 and height detection sensors 3*a* and 3*b* according to the present embodiment. The sensor unit 7 of the present embodiment includes the image sensor 14 and the height detection sensors 3*a* and 3*b* at both ends (both sides) in the X direction of the image sensor 14. By providing the height detection sensors 3*a* and 3*b* at both ends of the image sensor 14 in such a manner, even in a case where the carriage 9 that is moving in the X direction is inclined, the inclination of the image sensor 14 can be detected by detecting the distance from the printing medium 11 by use of the two height detection sensors 3*a* and 3*b*. Accordingly, it is possible to correct detection results obtained from the image sensor 14, based on the detected inclination of the image sensor 14.

For the correction, a correction value corresponding to the difference between a detection result obtained from the height detection sensor 3*a* and a detection result obtained from the height detection sensor 3*b* is prepared in advance and provided in the printing apparatus 100 as a table. By correcting a deviation amount detected by the image sensor 14 by use of such a correction value prepared in advance, it is possible to obtain a highly accurate conveyance amount of the printing medium 11. Note that a correction value corresponding to a difference between a detection result obtained from the height detection sensor 3*a* and a detection result obtained from the height detection sensor 3*b* depends on the distance between the height detection sensor 3*a* and the height detection sensor 3*b*. Therefore, it is desirable that a correction value is appropriately set for each apparatus according to the distance between a height detection sensor 3*a* and a height detection sensor 3*b*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-043646 filed Mar. 11, 2019, which is hereby incorporated by reference herein in its entirety.

What is claimed is:

1. An image printing apparatus comprising:

a printing unit configured to perform printing by ejecting liquid onto a printing medium;

a conveyance unit configured to convey the printing medium;

a conveyance amount detection unit configured to detect a conveyance amount of the printing medium conveyed by the conveyance unit;

a distance detection unit configured to detect a distance between the printing medium and the conveyance amount detection unit; and a correction unit configured to correct a detection result of the conveyance amount detection unit, based on a detection result of the distance detection unit.

2. The image printing apparatus according to claim 1, further comprising:

a carriage configured to reciprocally move in a main scanning direction, the carriage being mounted with the printing unit, wherein the conveyance amount detection unit and the distance detection unit are provided on the carriage.

3. The image printing apparatus according to claim 2, wherein the conveyance amount detection unit and the distance detection unit are arranged on the carriage so as to be adjacent to each other in the main scanning direction.

4. The image printing apparatus according to claim 2, wherein the distance detection unit includes a plurality of distance detection units, and wherein the plurality of distance detection units are provided so as to be adjacent to both sides of the conveyance amount detection unit in the main scanning direction.

5. The image printing apparatus according to claim 4, wherein inclination of the conveyance amount detection unit in the main scanning direction is detected by the plurality of distance detection units.

6. The image printing apparatus according to claim 1, wherein detection of the conveyance amount by the conveyance amount detection unit and detection of the distance by the distance detection unit are performed at a plurality of locations on the printing medium.

7. The image printing apparatus according to claim 6, wherein detection of the conveyance amount by the conveyance amount detection unit and detection of the distance by the distance detection unit are performed at two locations on the printing medium.

8. The image printing apparatus according to claim 1, wherein a correction amount of the detection result of the conveyance amount detection unit is stored, the correction amount corresponding to the detection result of the distance detection unit.

9. The image printing apparatus according to claim 1, wherein the detection result of the conveyance amount detection unit and the detection result of the distance detection unit are transmitted to an external apparatus, so that the external apparatus determines the conveyance amount of the printing medium and the printing medium is conveyed based on the determined conveyance amount.

10. The image printing apparatus according to claim 9, wherein the external apparatus determines the conveyance amount of the printing medium, and wherein the printing medium is conveyed by another image printing apparatus, other than the image printing apparatus, based on the determined conveyance amount.

11. A reading apparatus comprising:

a reading unit configured to read printing on a printing medium;

a conveyance unit configured to convey the printing medium;

a conveyance amount detection unit configured to detect a conveyance amount at a given location of the printing medium conveyed by the conveyance unit; and a distance detection unit configured to detect a distance between the printing medium and the conveyance amount detection unit, wherein a detection result of the conveyance amount detection unit is corrected based on a detection result of the distance detection unit.

12. An image printing method comprising:

a printing step for performing printing by ejecting liquid onto a printing medium;

a conveyance step for conveying the printing medium; and a conveyance amount detecting step for detecting a conveyance amount of the printing medium by use of a conveyance amount detection unit, the printing medium being conveyed in the conveyance step, wherein a detection result of the conveyance amount detecting step is corrected based on a distance between the printing medium and the conveyance amount detection unit.

13. A printing medium conveyance method comprising:

a conveyance step for conveying a printing medium; and a conveyance amount detecting step for detecting a conveyance amount of the printing medium by use of a conveyance amount detection unit, the printing medium being conveyed in the conveyance step, wherein a detection result of the conveyance amount detecting step is corrected based on a distance between the printing medium and the conveyance amount detection unit.

* * * * *